United States Patent [19]

Hisakawa et al.

[11] 4,286,887

[45] Sep. 1, 1981

[54] ENDLESS RIBBON CASSETTE

[75] Inventors: Minoru Hisakawa; Tsugio Okamoto, both of Nagoya, Japan

[73] Assignee: Brother Kogyo Kabushiki Kaisha, Aichi, Japan

[21] Appl. No.: 85,068

[22] Filed: Oct. 15, 1979

[30] Foreign Application Priority Data

Oct. 19, 1978 [JP] Japan ..... 53-144036[U]

[51] Int. Cl.[3] ..... B41J 33/10

[52] U.S. Cl. ..... 400/196.1; 400/248

[58] Field of Search ..... 400/194, 195, 196, 196.1, 400/248

[56] References Cited

U.S. PATENT DOCUMENTS

| | | | |
|---|---|---|---|
| 3,814,231 | 6/1974 | Cappotto | 400/196.1 X |
| 4,074,800 | 2/1978 | Steinke | 400/195 |

FOREIGN PATENT DOCUMENTS

| | | | |
|---|---|---|---|
| 2534535 | 2/1977 | Fed. Rep. of Germany | 400/196.1 |

OTHER PUBLICATIONS

Brumbaugh et al., IBM Technical Disclosure Bulletin, "Printer Ribbon Cassette", vol. 19, No. 8, Jan. 1977, pp. 2978–2979.

Dowd, IBM Technical Disclosure Bulletin, "Ribbon Cartridge Exit Impedance", vol. 20, No. 11B, Apr. 1978, pp. 4739–4740.

*Primary Examiner*—Ernest T. Wright, Jr.

*Attorney, Agent, or Firm*—Browdy and Neimark

[57] ABSTRACT

A ribbon cassette for a looped ink ribbon in a stuffed state is provided with a depending plate on a lower surface of a cover member, for covering a ribbon chamber, near an outlet opening in order to reduce a ribbon drawing-out force by taking advantage of a slight and not-excessive frictional resistance taking place there. The depending plate is in the form of an inverted isosceles triangle and the distance between the tip end of the triangle and a floor of the ribbon chamber is smaller than the width of the ribbon.

5 Claims, 5 Drawing Figures

ENDLESS RIBBON CASSETTE

BACKGROUND OF THE INVENTION

This invention relates to a ribbon cassette or cartridge and more particularly to an improved ribbon cassette in which the ribbon is stored in a stuffed state.

A ribbon cassette which is provided with means to prevent the ribbon from clogging the exit of the cassette is known by U.S. Pat. No. 3,814,231, wherein a shroud is formed around the exit area thereof, which is substantially a ridge projecting from the floor of the ribbon storage chamber. The distance from the top of the shroud to the ceiling of the storage chamber is so determined as to be less than the width of the ribbon, so that only one strand of the stuffed ribbon will be withdrawn from the storage chamber at a time.

The ridge of this type is however not fully effective or ideal for diminishing the frictional resistance which takes place in drawing out the ribbon from the cassette. How to diminish the frictional resistance is an important problem in order to accommodate a longer ink ribbon in the same size of a ribbon chamber and prolong the life of the ink ribbon as well.

SUMMARY OF THE INVENTION

It is a primary object of the invention to provide an improved ribbon cassette for a looped ink ribbon, in which the ink ribbon is stored in a stuffed state and can be drawn out with a small force.

It is another object of the invention to attain the above-mentioned purpose at a lowest manufacturing cost and with a simple structure.

In order to accomplish the objects of the invention, a depending plate is disposed on the lower surface of a cover member which covers the upper portion of the chamber for storing a ribbon fed thereinto by feed means. The chamber is formed by a floor and a wall with a depth slightly larger than the width of the ribbon. In the wall an inlet opening and an outlet opening are formed, and the depending plate is positioned near the outlet opening. And the depending plate has a base portion which is elongated in the direction perpendicular to the direction in which the ribbon moves from the inlet opening towards the outlet opening through a ribbon path, with the length of the base portion smaller than the width of the ribbon path. The depending plate depends from the cover member towards the floor so that the distance between the tip end of the depending plate and the surface of the floor is smaller than the width of the ribbon.

The depending plate is provided with a tip end and a pair of guide portions formed on both sides thereof in such a manner that the lower surface of the cover member is smoothly (steplessly) ascending with a gentle slope along each guide portion to the tip end, so that an engaging portion of the ribbon is smoothly guided from the base portion to the tip end of the depending plate.

The depending plate is of nearly isosceles triangle configuration in the specifically preferred embodiment.

DETAILED DESCRIPTION OF THE PREFERRED EMBODIMENT

Before entering a detailed description of the preferred embodiment of this invention, a short comment on a conventional type ribbon cassette, wherein the ribbon is folded or stuffed regularly in an almost perpendicular direction to the flow thereof, will be made for better understanding of the present invention.

Figure 1:
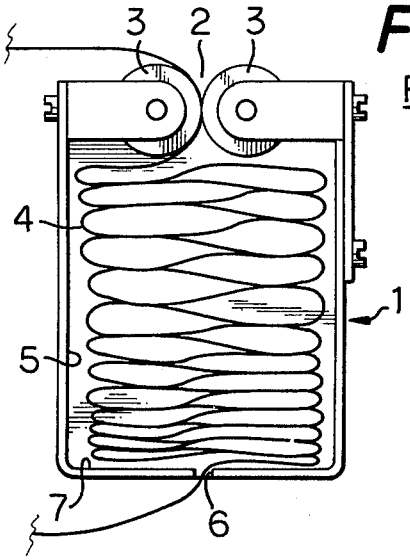
FIG. 1 PRIOR ART
FIG. 1 is a plan view of a conventional ribbon cassette with its cover being removed.

In the conventional ribbon cassette, as illustrated in FIG. 1, an endless-looped ink ribbon 4 is drawn in a stuffed state into a ribbon chamber 5 by means of a pair of feed rollers 3 which are provided in an inlet opening 2 of the ribbon cassette 1 while it is successively drawn out through an outlet opening 6 by means of the feed rollers 3. In such a type of ribbon cassette 1, it is known that the ink ribbon 4 housed within the ribbon chamber 5 is pressed towards the outlet opening 6 by the ink ribbon 4 which has been drawn-in with the feed rollers 3 resulting in that, as shown in FIG. 1, the ink ribbon 4 is stuffed loosely near the inlet opening 2 while it is stuffed closely near the outlet opening 6. In such a housed condition, the ink ribbon 4 near the outlet opening 6 is pressed between an inner surface 7 of the ribbon chamber 5 and the rest of the ribbon 4 far from the outlet opening 6, so that the pressure force acts as resistance to the delivery of the ink ribbon 4 from the outlet opening 6.

Figure 2:
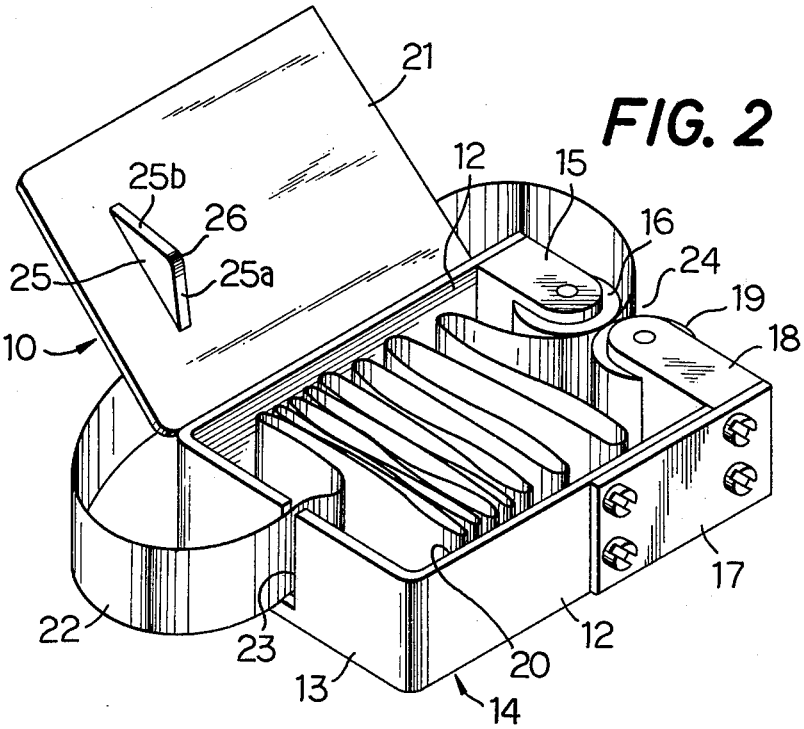
FIG. 2 is a perspective view of the ribbon cassette of an embodiment in accordance with this invention, with its cover being opened.

FIG. 2 is a perspective view of a ribbon cassette 10 according to this invention with a cover member 21 in an opened state. The ribbon cassette 10 has a housing 14 which consists of a nearly rectangular bottom wall 11 as a floor, a pair of side walls 12 formed perpendicularly and extentionally from both lateral ends of the bottom wall 11 and a rear wall 13 connecting both side walls 12.

Near the front end (right in FIG. 2) of the left side wall 12 is fixed a roller support 15 whereby a ribbon feed roller 16 is rotatably supported. On the other hand, near the front end of the right side wall 12 is fixed one end of a leaf spring 17, to the other end of which is secured a roller support 18 whereby a pressure roller 19 is rotatably supported in opposed relation to the ribbon feed roller 16. The pressure roller 19 is urged by the resilient force of the leaf spring 17 onto the ribbon feed roller 16 so as to be in elastic contact at all times.

The rollers 16, 19 and the roller supports 15, 18 substantially constitute a front wall which in turn, together with the bottom wall 11, side walls 12 and rear wall 13, constitute a complete ribbon chamber 20. On top of the housing 14 is mounted a cover member 21, capable of being opened and closed on occasion, to cover the ribbon chamber 20. When the cover member 21 is closed, the lower surface of the same constitutes as it is a ceiling for the ribbon chamber 20.

An endless-looped ink ribbon 22 is housed in large part in a stuffed state within the ribbon chamber 20, and a part of the ink ribbon 22 is outside the ribbon chamber 20 for being spanned between an outlet opening 23—which is formed as a perpendicular slot nearly centrally in the rear wall 13—and an inlet opening 24 formed by the ribbon feed roller 16 and pressure roller 19. When the ribbon cassette 10 is loaded on a typewriter or printer body, the ribbon feed roller 16 is connected with the ribbon feed roller mechanism in the typewriter or printer body whereby it is rotated intermittently or continuously in connection with the printing operation. By the rotation of the ribbon feed roller 16 the ink ribbon 22 held between the feed roller 16 and the pressure roller 19 is drawn out through the outlet opening 23 and, after passing the printing position of the typewriter or printer, it is drawn back into the ribbon chamber 20 through both rollers 16, 19.

Figure 3:
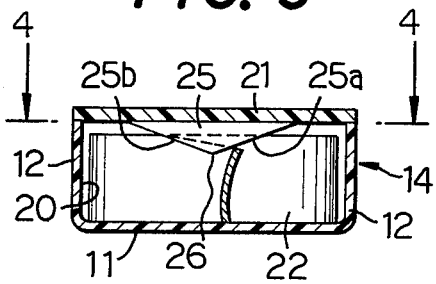
FIG. 3 is a sectional view of the ribbon cassette of the embodiment while the cover is closed.
Figure 4:
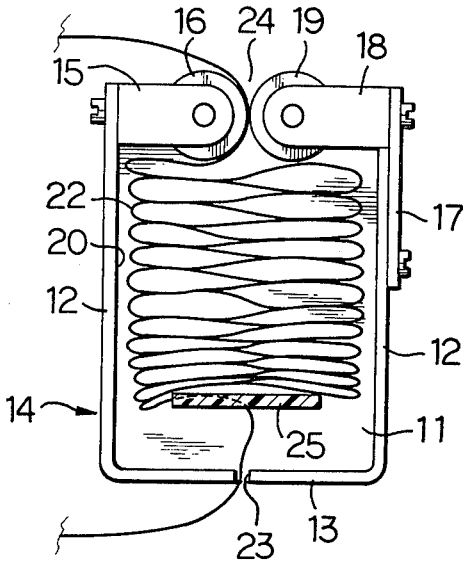
FIG. 4 is a sectional view taken along the line 4—4 of FIG. 3.

As shown in FIG. 3, the distance between the lower surface of the cover member 21 and the upper surface of the bottom wall 11 is slightly larger than the width of the ink ribbon 22 to make the movement of the ink ribbon 22 from the inlet opening 24 towards the outlet opening 23 smooth. As shown in FIGS. 2 and 3, moreover, a depending plate 25 in the form of an inverted isosceles triangle is formed on the lower surface of the cover member 21 in a position spaced by a distance equal to the ribbon width or so from the outlet opening 23. The depending plate 25 is formed such that, as shown in FIG. 4, the cross section of its base portion near the lower surface of the cover member 21 is in the form of a rectangle elongated in the direction perpendicular to the direction in which the ink ribbon 22 moves from the inlet opening 24 towards the outlet opening 23 through a ribbon path. The lateral length of the base portion of the depending plate 25 is smaller than the distance between both side walls 12 of the housing 14. The depending plate 25 of isosceles triangle shape has a roundish tip at its vertex, with the distance between the tip end 26 and the upper surface of the bottom wall 11 being smaller than the width of the ink ribbon 22, when the cover member 21 is closed, as shown in FIG. 3.

The depending plate 25, as shown in FIG. 4, is for giving a slight retardation or stagnation to the ink ribbon 22 which has been fed in a stuffed state towards the outlet opening 23. As illustrated also in FIG. 4, when the ink ribbon 22 is further pulled towards the outlet opening 23 from its retarded condition, one strand portion thereof which has been in abutment with the depending plate 25 is moved in stopping with a closer abutment at its upper edge ascending along an inclined portion 25*a* (or a slope) of the depending plate 25, whereupon the ribbon 22 is bent in the direction of its width as is shown in the sectional view of FIG. 3. As the ink ribbon 22 is further pulled, the ribbon portion which is in engagement (abutment) with the tip end 26 of the depending plate 25 is moved out of engagement therewith and the ink ribbon 22 moves from the state indicated with a solid line A to the state indicated with a broken line B in FIG. 5. A further feed of the ink ribbon 22 brings it into the state indicated with a dot and dash line C in FIG. 5, whereupon the upper edge of the ribbon 22 abuts the other inclined portion 25*b* (slope) of the depending plate 25, thus producing a symmetrical state with the state of the solid line A in FIG. 5. When, from this state, the upper edge of the ink ribbon 22 passes by the tip end 26, the next strand portion of the ribbon 22 is placed in a state not influenced by the tip end 26. Through repetition of such an operation the ink ribbon 22 is moved towards the outlet opening 23 while its remaining stuffed portions are freed from the depending plate 25 one by one.

Figure 5:
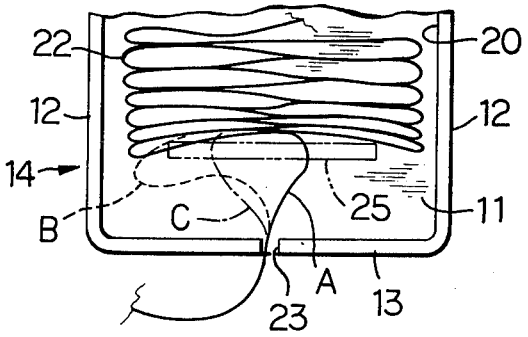
FIG. 5 is a partial view of FIG. 4 for showing the vicinity of the outlet opening on an enlarged scale.

When the ink ribbon 22 is drawn out in this way from the outlet opening 23, the upper and lower edges of the ribbon 22 are brought into frictional contact with the bottom wall 11 and the inclined portion 25*a* or 25*b* of the depending plate 25, respectively, during the movement of the ribbon 22 from the state of solid line A to that of broken line B in FIG. 5. This frictional contact acts as resistance when the ink ribbon 22 is drawn out, and shows the largest resistance value when the upper edge of the ribbon 22 passes by the tip end 26 of the depending plate 25. On the other hand, in the movement of the ink ribbon 22 from the state of broken line B to that of a dot and dash line C, the resistance is very small.

A practical test was made using a ribbon cassette having a ribbon chamber 45 mm wide, 113 mm long and 16 mm deep within which was placed an endless-looped ink ribbon about 14 mm wide by 20 m long. As a result, in the conventional type ribbon cassette 1 shown in FIG. 1 not provided with the depending plate 25, the ink ribbon drawing-out force was 15 to 25 g, while in the case of ribbon cassette 10 according to this invention provided with the depending plate 25 having a base portion 28 mm long and depending part 5 mm from the base portion as illustrated in FIGS. 2 through 5, the ribbon drawing-out force was 5 to 12 g and thus could be reduced to less than half of that in the conventional ribbon cassette 1. In the embodiment of this device, the ribbon drawing-out force shows its smallest value during the movement of the ink ribbon 22 from the state of broken line B to that of a dot and dash line C in FIG. 5, while it shows the largest value when the ink ribbon 22 passes by the tip end 26 of the depending plate 25.

As set forth hereinbefore, when the same size ink ribbon 22 is housed within the same size ribbon chamber 20, the ribbon cassette 10 of this invention is advantageous in that the ink ribbon 22 can be drawn out with less force than that required in the conventional type ribbon cassette 1. In other words, it means a longer ink ribbon 22 can be accommodated in the same size ribbon chamber 20. In the case of a ribbon cassette 10 according to this invention, moreover, there scarcely occurs the contact of the inked surface of the ink ribbon 22 with the rear wall 13 of the housing 14 near the outlet opening 23 of the ribbon chamber 20, as a result, the life of the ink ribbon 22 can be prolonged.

What is claimed is:

1. A ribbon cassette for an endless-looped ink ribbon of up to a given width, the cassette having a ribbon chamber which has an upper portion, a floor and a wall with a depth slightly larger than the given width of the ribbon for storing the ribbon in a stuffed state therein; an inlet opening and an outlet opening formed in said wall; a cover member having a lower surface covering said upper portion of said chamber; and ribbon feed means for feeding the ribbon into said chamber through said inlet opening and drawing out the ribbon from said chamber through said outlet opening, wherein the improvement comprises a depending plate formed on said lower surface of said cover member in a position near said outlet opening, said depending plate being in form of a substantially isosceles triangle which has a substantially roundish tip at its vertex, said depending plate having a base portion which is elongated in a direction perpendicular to that direction in which the ribbon moves from said inlet opening towards said outlet opening along a ribbon path of given width, with length of said base portion smaller than the given width of the ribbon path, and said depending plate depending from said cover member towards the floor such that the distance between said roundish tip at said vertex of said depending plate and the surface of the floor is smaller than the given width of the ribbon, while allowing the ribbon to pass over said roundish tip.

2. A ribbon cassette according to claim 1, wherein said outlet opening is constituted by a substantially vertical slit.

3. A ribbon cassette according to claim 1 or 2, wherein said vertex of said depending plate in form of a substantially isosceles triangle is aligned with said outlet opening.

4. A ribbon cassette according to claim 3, wherein all space between said outlet opening and said depending plate in form of a substantially isosceles triangle is entirely free and open.

5. A ribbon cassette according to claim 1 or 2, wherein all space between said depending plate in form of a substantially isosceles triangle is entirely free and open.

* * * * *